United States Patent [19]

Landau

[11] Patent Number: 5,052,648

[45] Date of Patent: Oct. 1, 1991

[54] SUSPENSION CABLE SHELF MOUNTING SYSTEM

[76] Inventor: Brian W. Landau, 7 Northern Blvd., Greenvale, N.Y. 11548

[21] Appl. No.: 589,219

[22] Filed: Sep. 28, 1990

[51] Int. Cl.[5] ..... A47F 5/00

[52] U.S. Cl. ..... 248/235; 24/115 H; 108/149; 248/328

[58] Field of Search ..... 248/235, 249, 317, 328; 108/96, 149; 24/115 H, 135 N

[56] References Cited

U.S. PATENT DOCUMENTS

| | | | |
|---|---|---|---|
| 1,273,922 | 7/1918 | Prattinger | 24/135 N |
| 2,091,868 | 8/1937 | Mattson | 108/149 |
| 2,306,266 | 12/1942 | Heim | 108/149 X |
| 2,556,105 | 6/1951 | Rhett | 108/149 X |
| 3,901,165 | 8/1975 | Schlesinger | 108/149 |
| 3,990,665 | 11/1976 | Joussemet | 108/149 X |
| 4,129,080 | 12/1978 | Vall | 108/149 |
| 4,187,787 | 2/1980 | Nakatsu | 108/149 X |
| 4,342,477 | 8/1982 | McClure | 24/135 N |
| 4,523,526 | 6/1985 | O'Neill | 108/149 |

FOREIGN PATENT DOCUMENTS

| | | | |
|---|---|---|---|
| 493288 | 5/1950 | Belgium | 108/149 |
| 345902 | 12/1904 | France | 108/149 |
| 53046 | 8/1911 | Switzerland | 24/135 N |
| 290159 | 10/1928 | United Kingdom | 108/149 |

*Primary Examiner*—David L. Talbott
*Attorney, Agent, or Firm*—Natter & Natter

[57] ABSTRACT

A wall shelf mount system includes a pair of suspended bracket units. Each bracket unit includes two channel sections. The channel sections have jaws spaced apart a distance less than the thickness of a shelf. A cable is threaded through registered transverse openings in the jaws and the ends of the cable include crimped eyelets. The shank of a wall fastener extends through both eyelets and into a wall to suspend the bracket unit from the wall as a closed loop. The front longitudinal edge of the shelf adjacent an end of the shelf is slipped between the legs of one channel section while the rear longitudinal edge is inserted between the jaws of the other channel section. An alternate structure includes a socket fastened to the wall with the cable threaded through an opening in the bottom of the socket and retained by an enlargement at the end of the cable. The opposite end of the cable extends through a bore in a plug with a transverse set screw bearing against the cable. The plug is inserted in an opening at the top of the socket to fasten both ends of the cable to the wall.

9 Claims, 2 Drawing Sheets

FIG. 1
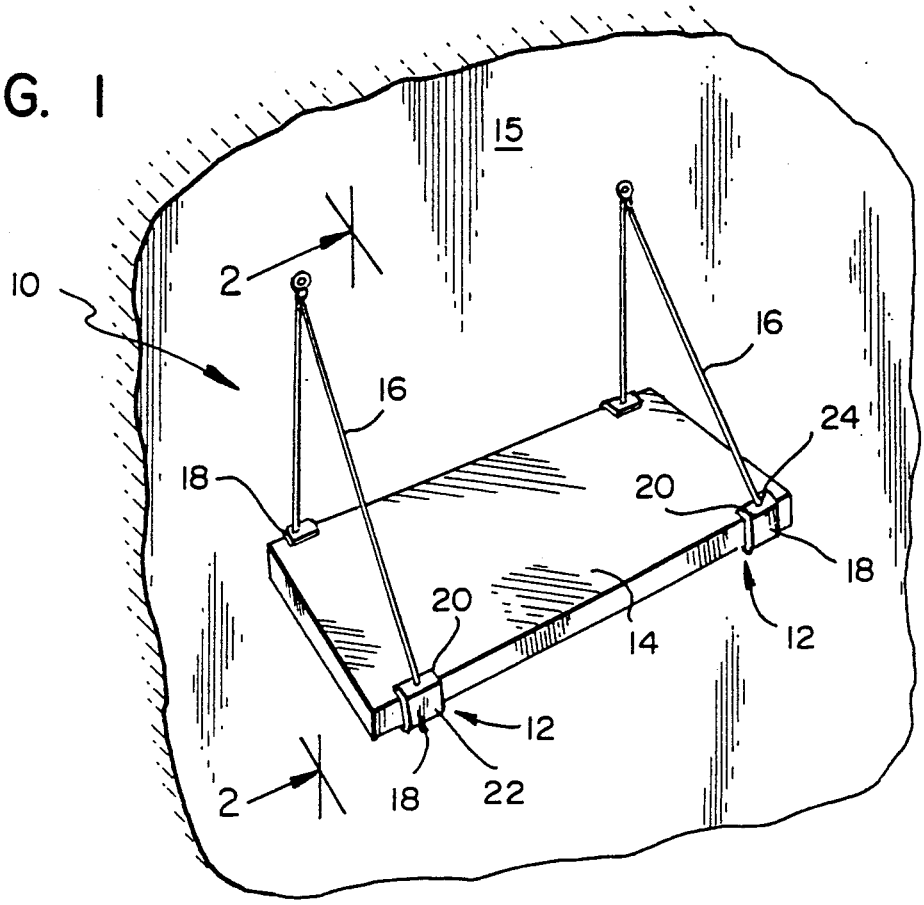
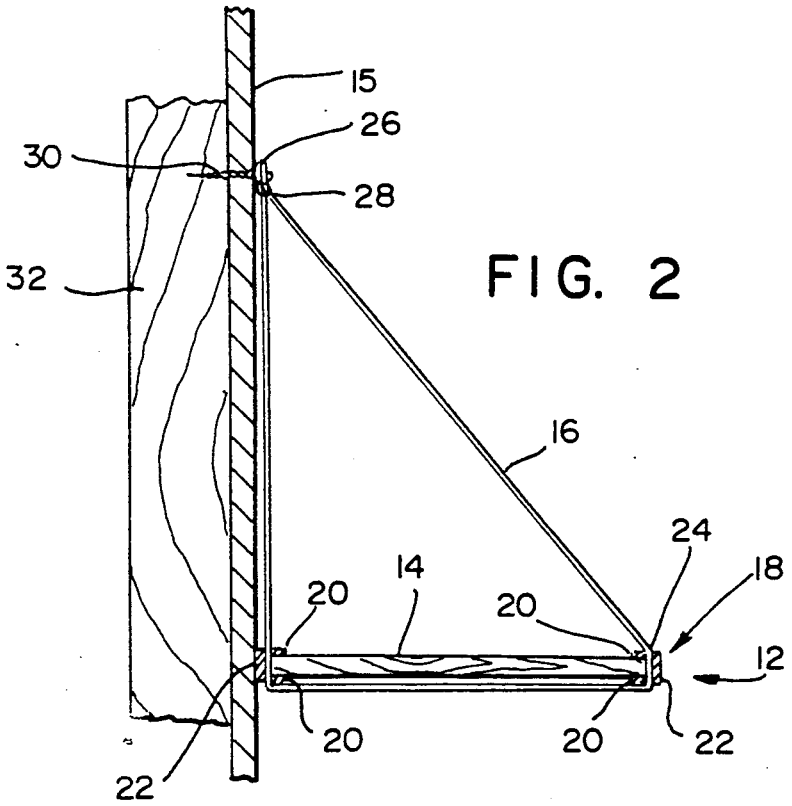
FIG. 2
FIG. 3
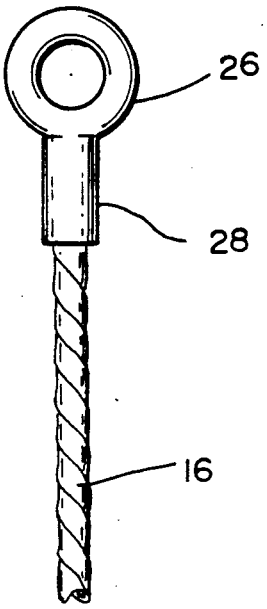

FIG. 4
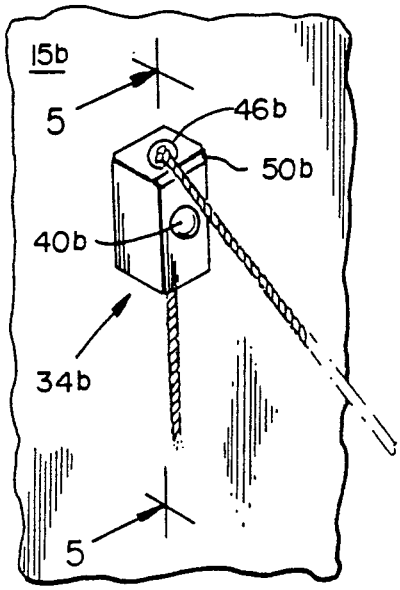
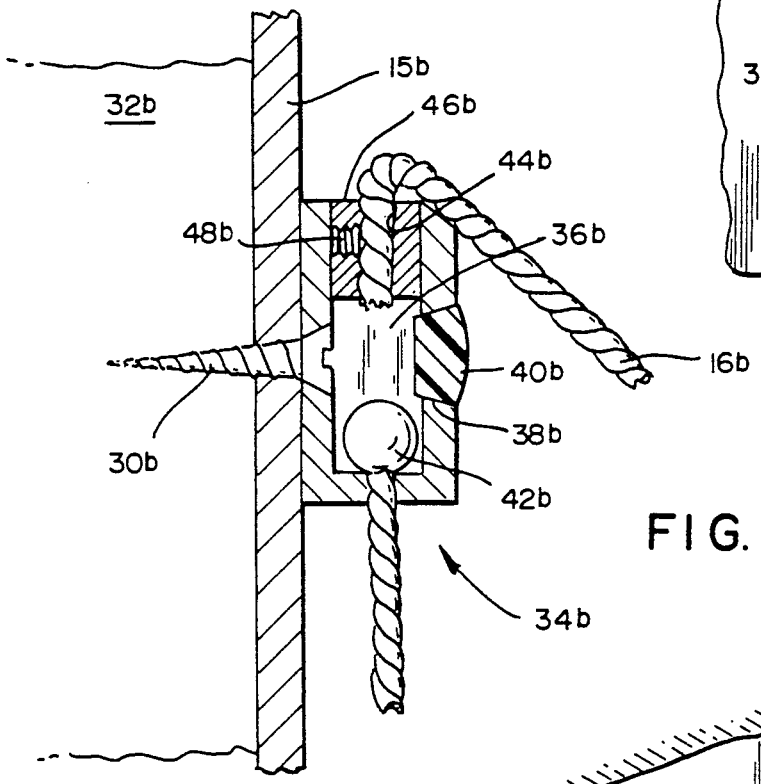
FIG. 5
FIG. 6
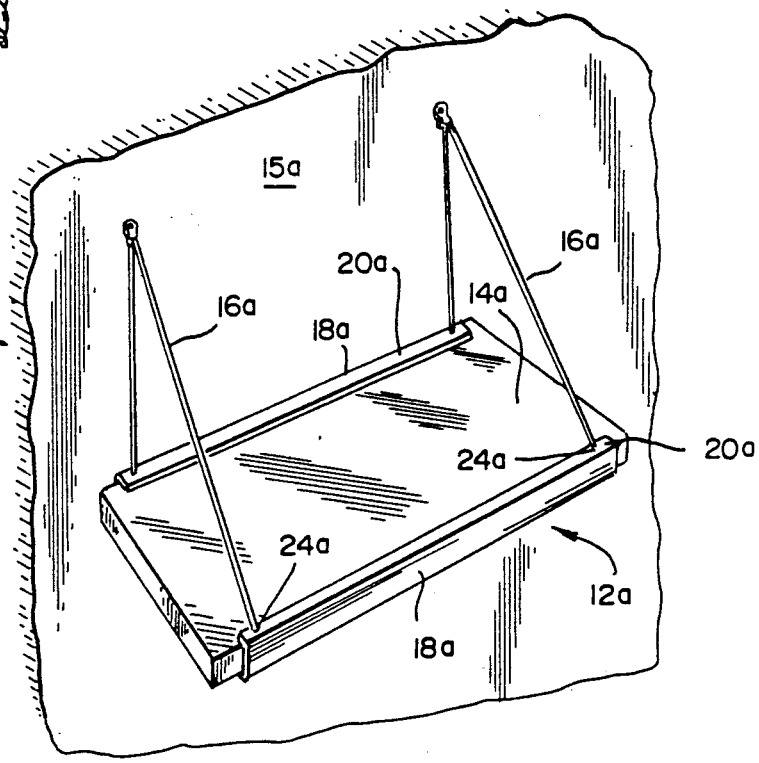

SUSPENSION CABLE SHELF MOUNTING SYSTEM

BACKGROUND OF THE INVENTION

1. Field of the Invention

This invention relates generally to wall shelving and more particularly to a cable supported adjustable shelf bracket system.

2. Background History

The assembly, arrangement and mounting of wall shelving has presented challenges both in home, office and industrial environments. While the basic right angle bracket adequately served the purpose of supporting a shelf in utilitarian applications, the mounting of a shelf using such brackets required the use of multiple fasteners for each bracket and securement of such fasteners into a wall as well as into the shelf itself. This of course entailed additional problems in instances wherein the shelf bracket location did not coincide with a vertical stud in a hollow wall. The procedure was, to say the least, tedious and time consuming. Shelf rearrangement for subsequent decoration and/or functional considerations which involved repositioning of brackets was an unfavored task.

While the use of slotted rail shelving systems reduced the total number of individual wall fasteners required for multiple shelves, such systems constricted shelving arrangement configurations since all shelves in an area were required to be accommodated by vertically registered brackets which were received in spaced openings of the rails. Also, shelf depth was dictated by the lengths of available brackets.

SUMMARY OF THE INVENTION

In compendium, the invention comprises a wall shelf mounting system which utilizes a pair of suspension cables, the ends of each of which are fastened to a wall to form a pair of closed loops which are strung beneath and support a horizontal shelf. Each cable is incorporated in a bracket unit which includes a pair of channel sections having parallel jaws. The cables are threaded through transverse openings in the jaws and the cable is strung beneath the shelf with the front and rear longitudinal edges of the shelf being slipped between the jaws of the channel sections.

Eyelets are crimped to the ends of the cable and a wall fastener such as a screw or nail is inserted through the eyelets.

In lieu of eyelets, an alternate embodiment employs a hollow socket mounted to the wall. The cable is threaded through an opening in the bottom of a socket and is retained by an enlargement at one end of the cable. The opposite end of the cable extends through an axial bore in a plug and is secured to the plug by a transverse set screw. The plug is fitted into an opening in the top of the socket.

With the foregoing summary in mind, it should be appreciated that it is a consideration of the present invention to provide a suspension cable shelf mounting system of the general character described which is not subject to the disadvantages of the background history aforementioned.

An aspect of the present invention is to provide a suspension cable shelf mounting system of the general character described which is relatively simple to use.

It is a feature of the present invention to provide a suspension cable shelf mounting system of the general character described which can accommodate a wide range of shelf dimensions.

Another consideration of the present invention is to provide a suspension cable shelf mounting system of the general character described wherein only a single fastener is required adjacent each end of a shelf.

A further feature of the present invention is to provide a suspension cable shelf mounting system of the general character described suitable for a wide variety of shelving arrangements.

To provide a suspension cable shelf mounting system of the general character described which is relatively low in cost and well suited for mass production fabrication is a further consideration of the present invention.

Other aspects, features and considerations of the present invention in part will be obvious and in part will be pointed out hereinafter.

With these ends in view, the invention finds embodiment in certain combination of elements, arrangements of parts and series of steps by which the aforesaid aspects, features and considerations are attained, all with reference to the accompanying drawings and the scope of which will be more particularly pointed out and indicated in the appended claims.

BRIEF DESCRIPTION OF THE DRAWINGS

In the accompanying drawings in which are shown some of the various possible exemplary embodiments of the invention:

FIG. 1 is a perspective illustration of a shelf mounted to a wall with a suspension cable shelf mounting system constructed in accordance with and embodying the invention and illustrating a pair of bracket units each having two channel sections and a cable strung beneath the shelf and with the front and rear edges of the shelf being positioned between jaws of the channel sections;

FIG. 2 is an enlarged scale fragmentary sectional view through the shelf and suspension cable mounting system, the same being taken substantially along the plane 2—2 of FIG. 1 and illustrating the cable extending through transverse openings in the jaws and transversely beneath the bottom of the shelf;

FIG. 3 is an enlarged scale fragmentary plan view of the cable and showing an eyelet crimped to an end of the cable;

FIG. 4 is a perspective view of an alternate embodiment of the invention where a socket is employed for fastening the ends of the cable to a wall;

FIG. 5 is an enlarged scale sectional view through the socket and wall, the same being taken substantially along the plane 5—5 of FIG. 4; and FIG. 6 is a perspective view of a still further embodiment of the invention wherein a single channel section is employed for the entire front edge of the shelf and a single channel section is employed for the rear shelf edge.

DESCRIPTION OF THE PREFERRED EMBODIMENTS

Referring now in detail to the drawings, the reference numeral 10 denotes generally a suspension cable shelf mounting system constructed in accordance with and embodying the invention. The system 10 includes a pair of bracket units 12 for supporting a shelf 14 from a vertical support surface such as a wall 15. Each bracket unit 12 includes a length of braided wire cable 16 looped beneath the shelf 14 and a pair of channel sections 18 for stabilizing the shelf.

The channel sections 18 include a pair of spaced generally planar jaws 20 joined by a planar spine 22. The channel sections 18 may be formed of a suitable substantially rigid material such as metal, e.g. aluminum, or thermoplastic. Extending transversely through each of the jaws 20 and adjacent the inner face of the spine 22 is a pair of registered openings 24 through which the cable 16 is threaded.

As illustrated in FIG. 2 and FIG. 3, an eyelet 26 is fastened to each end of the cable 16. The eyelet includes a depending hollow sleeve 28 within which the cable end is received and the sleeve is thereafter crimped to secure the cable end.

To mount the shelf 14, each cable is strung beneath the shelf and the front and rear longitudinal edges of the shelf are slipped between the jaws 20 of the channel sections 18 of one bracket unit adjacent one end of the shelf while the front and rear longitudinal edges of the shelf are slipped between the legs of the channel sections of the other bracket unit adjacent the other end of the shelf.

From an examination of FIG. 2 it will be observed that the respective longitudinal shelf edges abut a portion of the cable which spans between the jaws and do not contact the inner faces of the spines. In addition, the cable 16 is shown strung beneath the shelf 14 spaced from and parallel to the bottom face of the shelf.

After the desired position of the shelf relative to the wall 15 is determined, a suitable fastener such as a nail or screw 30 is inserted through the registered openings of both eyelets 26 and into the wall 30 and preferably into a supporting stud 32. If the desired location of the fastener on the wall 15 is not registered with a stud 32, a conventional hollow wall fastener may be employed. The position of the bracket units 12 along the length of the shelf 14 is not critical and, in appropriate instances, supporting wall studs 32 may be first located and the bracket units located and/or fastened to the wall 15 mounted prior to positioning the bracket units relative to the shelf.

As previously mentioned, the channel sections serve to stabilize the shelf relative to the cable. This is accomplished by providing a relatively snug fit at the jaw openings 24 which coupled with the sharp bend in the cable at the lower jaw opening prevents the shelf from moving from its horizontal position. The channel sections 18 also prevent lateral movement of the shelf relative to the cable by frictional or clamping engagement between the jaws and the top and bottom faces of the shelf.

It should be observed that the suspension cable shelf mounting system 10 is quite versatile and readily accommodates shelves of various depth. Significantly, only a single fastener 30 is required in conjunction with each bracket unit 12.

A further embodiment of the invention is illustrated in FIG. 6 wherein like numerals have been employed to denote like components of the embodiment previously described, however, bearing the suffix "a". In this embodiment, a suspension cable shelf mounting system **10*a* includes a single bracket unit 12*a* for supporting a shelf 14*a*. The bracket unit 12*a* is similar to the bracket unit 12 previously described, however, in lieu of employing two bracket units each including a cable and a pair of channel sections, the bracket unit 12*a* includes a pair of cables 16*a*, a single channel section 18*a* for the front edge of the shelf 14*a* and a single channel section 18*a* for the rear edge of the shelf 14*a***.

The channel sections **18*a* are substantially identical to the channel sections previously described except and include a pair of spaced jaws 20*a*. The channel sections span practically the entire length of the shelf and a set of registered transverse openings 24*a* are provided through the jaws 20*a*** adjacent each end.

In FIGS. 4 and 5, a still further embodiment of the invention is illustrated and wherein like numerals are employed to denote like components of the previous embodiment, however bearing the suffix "b". In this embodiment, an alternate wall fastening arrangement is employed which permits simple adjustment of cable lengths. The channel sections and the threading of the cable through the channel sections is identical to that employed with respect to either of the previously described embodiments and is not illustrated in FIGS. 4 and 5.

In this embodiment, a socket **34*b* is provided for joining the ends of a cable 16*b* together and securing the cable to a wall 15*b*. The socket 34*b* includes four substantially rectangular planar faces and a cylindrical bore 36*b*. A rear face 38*b* is adapted for securement in abutting relationship against a surface of a wall 15*b*. The socket 34*b* includes an opening between the cylindrical bore 36*b* and the rear face 38*b* for receiving a fastener 30*b* such as a screw. An access opening 38*b* is provided in the front face of the socket 34*b* for driving the fastener 30*b* into the wall 15*b*. The opening 38*b* may be thereafter closed with a suitable plug 40*b***.

The bottom of the socket **34*b* includes an opening through which the cable 16*b* is threaded. An enlargement 42*b* is provided at the end of the cable 16*b* for anchoring the cable end within the socket 34*b*. The enlargement may comprise a bead cast or crimped to the cable 16*b*** at its end. As with the prior embodiments, the cable is threaded through transverse openings in channel sections of a bracket unit.

The other end of the cable is threaded through an axial passage **44*b* of a cylindrical plug 46*b*. After the position of the plug 46*b* relative to the desired length of the cable 16*b* has been determined, the excess cable is cut off and a set screw 48*b*, which extends in a threaded axial bore of the plug 46*b*, is tightened to secure the cable 16*b* relative to the plug 46*b*. Thereafter, the plug is inserted into the socket bore 36*b* which is accessed through an open top of the socket. In order to avoid sharp engagement between a sharp corner of the socket and the cable 16*b*, the front face of the cable includes an upper chamfer 50*b***.

It should be appreciated that the cables need not be formed of braided wire and any flexible mono or multi filament material having suitable tensile strength for supporting the weight of the shelf and its contents may be utilized. Additionally, alternate arrangements for fastening the ends of a cable to a wall or other vertical support surface may be employed without departing from the spirit of the invention. Further, the channel sections may be flexible and the channel jaws may be spring biased to grip against the top and bottom of the shelf.

Thus, it will be seen, that there is provided a suspension cable shelf mounting system which achieves the various aspects, features and considerations of the present invention and which is well suited to meet the conditions of practical usage.

As various changes might be made in the invention as above set forth, it is to be understood that all matter herein described or shown in the accompanying drawings is to be interpreted as illustrative and not in a limiting sense.

Having thus described the invention there is claimed as new and desired to be secured by Letters Patent:

1. A shelving arrangement comprising a generally planar shelf having substantially parallel front and rear longitudinal edges and generally planar, parallel top and bottom faces, mounting means suspending the shelf in a substantially horizontal position from a substantially vertical support surface, the mounting means comprising a plurality of flexible cables, means for mounting each cable to the support surface, at least one channel associated with each longitudinal shelf edge, each channel comprising a pair of substantially planar parallel jaws, one jaw gripping the top shelf face and the other jaw gripping the bottom shelf face, the jaws being spaced apart a distance not greater than the distance between the shelf faces, each channel further including a spine interconnecting the jaws, the spine having an inner face extending substantially perpendicular to the jaws and spaced from the associated longitudinal shelf edge, each channel further including means forming an opening through each jaw adjacent the inner face of the spine, the cable extending through the opening of the jaw gripping the top face and being in contact with both the inner face of the spine and the one longitudinal shelf edge, the inner face of the spine being spaced from the associated longitudinal shelf edge a distance substantially the thickness of the cable, the cable extending through the opening of the jaw gripping the bottom face, the cable being bent substantially perpendicularly beneath the jaw gripping the bottom face and spanning beneath the bottom face and across the depth of the shelf, the cable being bent substantially perpendicularly and extending through the opening in the channel jaw gripping the bottom shelf face adjacent the other longitudinal shelf edge, the cable spanning the jaws substantially parallel to the plane of the bottom face and being spaced from the bottom face a distance not less than the thickness of the jaws gripping the bottom face, the cable being stabilized relative to the shelf by engagement with the jaw openings, the longitudinal shelf edges of the inner faces of the spines and the perpendicular bend in the cable at the openings through the jaws gripping the bottom face, the mounting means being free of further stabilizing means.

2. A shelving arrangement as constructed in accordance with claim 1 further including a plurality of channels associated with each longitudinal edge and a like plurality of flexible cables, each flexible cable being engaged through the openings of two separate channels.

3. A shelving arrangement as constructed in accordance with claim 2 wherein a pair of cables are provided, each cable being positioned adjacent an end of the shelf.

4. A shelving arrangement as constructed in accordance with claim 1 wherein the cables comprise braided wire.

5. A shelving arrangement as constructed in accordance with claim 1 wherein the means for mounting each cable to the support surface comprises a socket, means forming a bore in the socket, the bore having a longitudinal axis, the bore being open at one end and substantially closed at its other end, an aperture extending coaxially through the substantially closed end, the cable extending through the aperture adjacent one cable end and means within the bore for preventing the cable from being drawn through the aperture, the system further including a plug, means fixing the cable to the plug adjacent the other cable end, the plug being dimensioned compatibly with the bore to be snugly received in the bore through the open end with the cable being coaxial with the longitudinal axis, means for anchoring the socket relative to the support surface and for positioning the socket relative to a cable load such that a substantially axial tension load is applied to the cable portion associated with the aperture and the load at the cable portion associated with the plug comprises a tension load applied at an acute angle to the axial tension load so as to preclude dislodgement of the plug from the socket, the means for anchoring the socket to the support surface comprising a fastener.

6. A shelving arrangement as constructed in accordance with claim 5 wherein the means for preventing the cable from being drawn through the aperture comprises an enlargement on the cable.

7. An anchoring system for mounting a pair of cable ends to a support surface, the system comprising a socket, means forming a bore in the socket, the bore having a longitudinal axis, the bore being open at one end and substantially closed at its other end, an aperture extending coaxially through the substantially closed end, the cable extending through the aperture adjacent one cable end and means within the bore for preventing the cable from being drawn through the aperture, the system further including a plug, means fixing the cable to the plug adjacent the other cable end, the plug being dimensioned compatibly with the bore to be snugly received in the bore through the open end with the cable being coaxial with the longitudinal axis, means for anchoring the socket relative to the support surface and for positioning the socket relative to a cable load such that a substantially axial tension load is applied to the cable portion associated with the aperture and the load at the cable portion associated with the plug comprises a tension load applied at an acute angle to the axial tension load so as to preclude dislodgement of the plug from the socket, the means for anchoring the socket to the support surface comprising a fastener.

8. An anchoring system as constructed in accordance with claim 7 wherein the means for preventing the cable from being drawn through the aperture comprises an enlargement on the cable.

9. A shelving arrangement as constructed in accordance with claim 7 wherein the fastener is elongate, the socket including an aperture extending transversely from the bore and through a wall of the socket, the fastener extending through the aperture and into the support surface, the socket further including transverse access aperture for driving the fastener, the access aperture being in registry with the fastener aperture and plug means for selectively closing the access aperture to conceal the fastener.

* * * * *